US006861796B2

(12) United States Patent
Ko

(10) Patent No.: US 6,861,796 B2
(45) Date of Patent: Mar. 1, 2005

(54) CATHODE RAY TUBE

(75) Inventor: Sung Woo Ko, Gumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/154,918

(22) Filed: May 28, 2002

(65) Prior Publication Data

US 2003/0030364 A1 Feb. 13, 2003

(30) Foreign Application Priority Data

Jul. 23, 2001 (KR) ..... 2001-44302

(51) Int. Cl.[7] ..... H01J 29/10

(52) U.S. Cl. ..... 313/477 R; 313/402; 313/404; 313/461

(58) Field of Search ..... 313/402–404, 313/407–409, 422, 428, 461, 474, 477 R, 478, 495–497; 220/2.1 A

(56) References Cited

U.S. PATENT DOCUMENTS

| | | | | | |
|---|---|---|---|---|---|
| 4,341,980 | A | * | 7/1982 | Noguchi et al. | 315/169.1 |
| 5,304,890 | A | | 4/1994 | Tsukui et al. | 313/477 R |
| 5,357,165 | A | * | 10/1994 | Shibaoka et al. | 313/477 R |
| 5,365,142 | A | * | 11/1994 | Nishimura et al. | 313/2.1 |
| 5,532,545 | A | * | 7/1996 | Okamoto et al. | 313/407 |
| 5,691,597 | A | * | 11/1997 | Nishimura et al. | 313/402 |
| 5,864,205 | A | * | 1/1999 | Dworsky | 313/495 |
| 5,959,399 | A | * | 9/1999 | Arimoto et al. | 313/461 |
| 6,025,676 | A | * | 2/2000 | Ohama et al. | 313/477 R |
| 6,046,540 | A | * | 4/2000 | Nakamura | 313/461 |
| RE36,838 | E | * | 8/2000 | Sugawara et al. | 313/477 R |
| 6,133,686 | A | * | 10/2000 | Inoue et al. | 313/477 R |
| 6,198,214 | B1 | * | 3/2001 | Anandan et al. | 313/495 |
| 6,225,735 | B1 | * | 5/2001 | Nakagawa et al. | 313/407 |
| 6,407,493 | B1 | * | 6/2002 | Sugawara et al. | 313/461 |
| 6,448,707 | B1 | * | 9/2002 | Yoon et al. | 313/480 |
| 6,476,547 | B1 | * | 11/2002 | Kawase | 313/495 |
| 6,488,166 | B2 | * | 12/2002 | Swank et al. | 220/2.1 R |
| 6,534,907 | B1 | * | 3/2003 | Yoshida et al. | 313/466 |
| 6,583,552 | B1 | * | 6/2003 | Koyama | 313/495 |
| 6,630,782 | B1 | * | 10/2003 | Nakatani et al. | 313/496 |

FOREIGN PATENT DOCUMENTS

| | | | |
|---|---|---|---|
| CN | 1277455 A | 12/2000 | |
| CN | 1297248 A | 5/2001 | |
| EP | 0 764 964 A | 3/1997 | |
| EP | 1 081 739 A | 3/2001 | |
| JP | 04-190545 | 8/1992 | H01J/31/12 |
| WO | WO 94 18694 A | 8/1994 | |

OTHER PUBLICATIONS

Goede W.F. : "Flat Cathode Ray Tubes" *Journal of Vacuum Science and Technology*, New York, NY. vol. 10, No. 5, pp. 768–771, Sep. 1, 1973.

* cited by examiner

*Primary Examiner*—Joseph Williams
*Assistant Examiner*—Dalei Dong
(74) *Attorney, Agent, or Firm*—Fleshner & Kim, LLP

(57) ABSTRACT

A cathode ray tube having a panel with a fluorescent film made of a fluorescent material coated at the inner surface thereof; a cathode mounted in the panel and generating an electron beam; an electron beam controller for controlling and deflecting the electron beam in order to hit the fluorescent film; and a back glass attached to the panel and sealed in a state that the cathode and the electron beam controller are mounted therein, in which a ratio of a minimum thickness of a panel glass to a minimum thickness of a skirt portion of the panel is below 1.0. The full depth of the cathode ray tube is reduced and the weight of the cathode ray tube is minimized by controlling the thickness of the panel glass, the skirt portion of the panel glass and the back glass. In addition, the atmospheric pressure applied to the panel glass and the back glass is uniformly distributed to the panel glass, the back glass and the skirt portion, thereby performing a deformation.

21 Claims, 7 Drawing Sheets

CATHODE RAY TUBE

BACKGROUND OF THE INVENTION

1. Field of the Invention

The present invention relates to a cathode ray tube, and more particularly, to a cathode ray tube that is capable of reducing a full length of a cathode ray tube by controlling thickness of panel glass, a skirt portion of a panel and a back glass, minimizing a weight of the cathode ray tube and buffering an atmospheric pressure.

2. Description of the Background Art

As shown in FIG. 1, a conventional flat cathode ray tube includes: a panel glass 1 having a fluorescent material coated at the inner surface; a funnel glass 5 adhered at a rear end of a panel glass 1; a shadow mask 2 mounted at an inner side of the panel glass 1 with a certain space therebetween and having a plurality of holes to pass electron beams; an electron gun 3 sealed in the neck portion of the funnel glass 5 and radiating the electron beam; and a deflection yoke 4 for deflecting the electron beams discharged from the electron gun.

The panel glass 1 obtains the minimum space so that the electron beams can accurately light a screen, and maintains a high vacuum state to prevent a collision with other particles. In order to reduce an influence of an electric field to the electron beams, black lead is coated inside the panel glass.

In the cathode ray tube constructed as described above, electrons are activated at a cathode oxide and discharged, and electrons of the fluorescent material are excited with a kinetic energy accelerated by scores of kV accelerating electrode, to emit light. In this respect, about 75~80% of electrons is blocked by the shadow mask (2) and only the remaining reaches the screen.

At this time, as for the electrons blocked by the shadow mask 2, the kinetic energy of the electrons is mostly transformed to a thermal energy and the remaining is transformed to electromagnetic wave or the like.

The cathode ray tube that uses the electrons as an energy source and displays information on the screen by using the deflection yoke 4 requires a housing structure for obtaining a space in which electrons can move. The housing structure is made of an insulation material, can endure an atmospheric pressure, should have a little outgassing in collision with electrons, should be transparent and stable physically and chemically even at a temperature process of 370~450° C.

Accordingly, the housing structure of the most cathode ray tube is made of glass, a material that satisfies the above indicated conditions.

However, since the conventional cathode ray tube has one place of energy source for displaying information on the screen and uses only one deflection yoke 4, it is difficult to implement a deflection sensitivity of above a certain level.

Accordingly, in order to display accurate information on the screen, comparatively large internal space is necessary, which is obtained by the panel glass 1 and the funnel glass 5.

In order to prevent deformation and damage due to the atmospheric pressure working and stress occurrence, the panel glass 1 should have a certain thickness, and the funnel glass 5 has a smooth curved form in view of obtaining a space and coping with a vacuum strength.

If the width of the portion where the funnel glass 1 and the panel glass 5 are sealed is thinner than the thickness of the panel glass 1, the thickness of the funnel glass 5 is thinner than the panel glass 1 on the whole.

In the cathode ray tube with the above described structure, even if the panel glass 1 receives a force vertically by atmospheric pressure, the force is transmitted to the funnel glass 5, and the force which has been transferred to the funnel glass 5 is distributed to the funnel glass 5 in a form of hemisphere, thereby preventing deformation of the panel glass 1.

FIGS. 4A and 4B are graphs showing a ratio of a minimum thickness of the panel glass 1 to a minimum thickness of a skirt portion of the panel glass 1, of which FIG. 4A shows a cathode ray tube having the width-to-length ratio of a screen is 4:3 and FIG. 4B shows a cathode ray tube having the width-to-length ratio of 16:9.

As shown in FIGS. 4A and 4B, in a size more than 8 inches, the ratio of the minimum thickness of the panel glass 1 to the minimum thickness of the skirt portion of the panel glass 1 is above 1.15, and this ratio is increased for a flat type cathode ray tube.

However, such a cathode ray tube has a great volume due to the curved funnel glass 5 and very complicated internal structure.

Thus, in an effort to solve the problem, instead of the funnel glass 5 as shown in FIG. 2, a back glass 6 is used to form a flat type cathode ray tube with a reduce the front length.

As shown in FIG. 3, the flat type cathode ray tube includes, a cathode 8 positioned between the panel 1 glass and the back glass 6 and generating electron beams, an electrode 9 for emitting an electron beam at the entire surface of the cathode 8, a control electrode 10 for controlling the electron beam; two electrodes 11 and 12 for focussing the electron beam, a horizontal deflection electrode 13 and a vertical deflection electrode 15 for deflecting the electron beam.

Reference numeral 7 denotes a back electrode and 14 denotes a $G_{shield}$.

The flat type cathode ray tube adopts a deflection method of a passive driving method, of which the panel glass 1, the back glass 6 and the skirt portion 1*a* have the same thickness.

In this respect, however, the skirt portion 1*a* makes a working point of every force applied to the atmospheric pressure, and in case of the cathode ray tube having the short depth, there is a limitation that the skirt portion 1*a* distributes a force, resulting in that the skirt portion 1*a* is deformed partially and seriously, and in a worse case, the skirt portion 1*a* is damaged.

SUMMARY OF THE INVENTION

Therefore, an object of the present invention is to provide a cathode ray tube that is capable of reducing a full depth of a cathode ray tube by controlling thickness of panel glass, a skirt portion of a panel and a back glass, minimizing a weight of the cathode ray tube and buffering an atmospheric pressure.

To achieve these and other advantages and in accordance with the purpose of the present invention, as embodied and broadly described herein, there is provided a cathode ray tube having a panel with a fluorescent film made of a fluorescent material coated at the inner surface thereof; a cathode mounted in the panel and generating an electron beam; an electron beam controller for controlling and deflecting the electron beam in order to hit the fluorescent film; and a back glass attached to the panel and sealed in a state that the cathode and the electron beam controller are mounted therein, in which a ratio of a minimum thickness of a panel glass to a minimum thickness of a skirt portion of the panel is below 1.0, a ratio of a minimum thickness of the back glass to a minimum thickness of the skirt portion of the panel is below 1.0, and the thickness of the skirt portion of the panel, the thickness of the panel glass, and the thickness of the back glass satisfy the following equation (1):

$$0.7 \leq \frac{\text{thickness of panel glass} \times \text{thickness of back glass}}{\text{Minium thickness of skirt portion}^2} \leq 1.1 \quad (1)$$

The cathode ray tube of the present invention has a full depth of below 200 mm and a diagonal length of the panel of above 8 inches.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
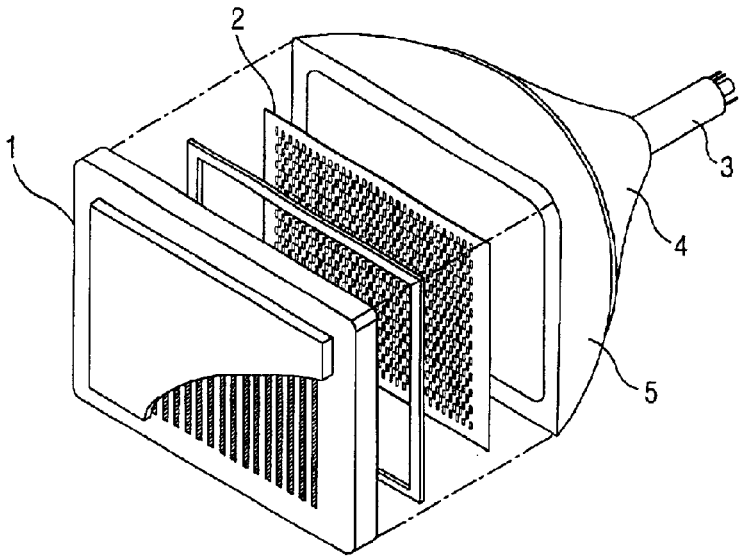
FIG. 1 CONVENTIONAL ART
FIG. 1 is a view showing the structure of a cathode ray tube in accordance with a conventional art.
Figure 2:
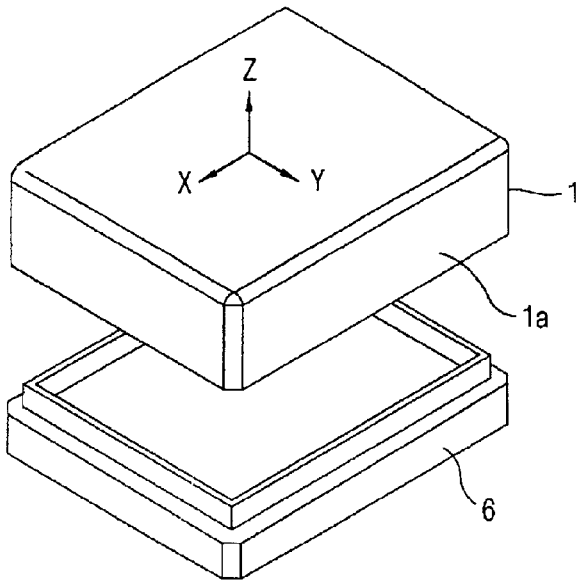
FIG. 2 CONVENTIONAL ART
FIG. 2 is a view showing a panel glass and a back glass of a flat type cathode ray tube in accordance with the conventional art.
Figure 3:
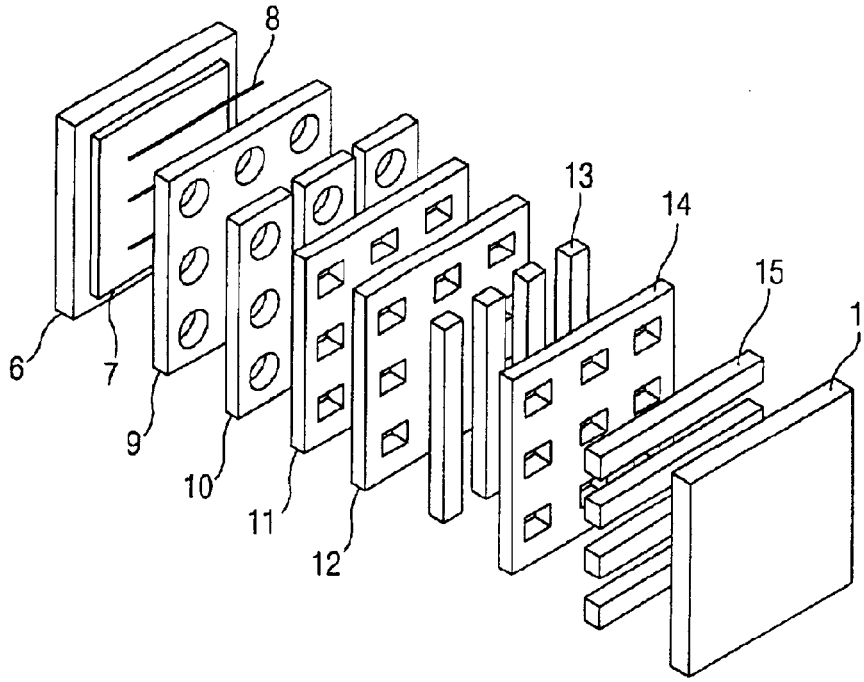
FIG. 3 CONVENTIONAL ART
FIG. 3 is a view showing an internal structure of the flat type cathode ray tube in accordance with the conventional art.
Figure 4A:
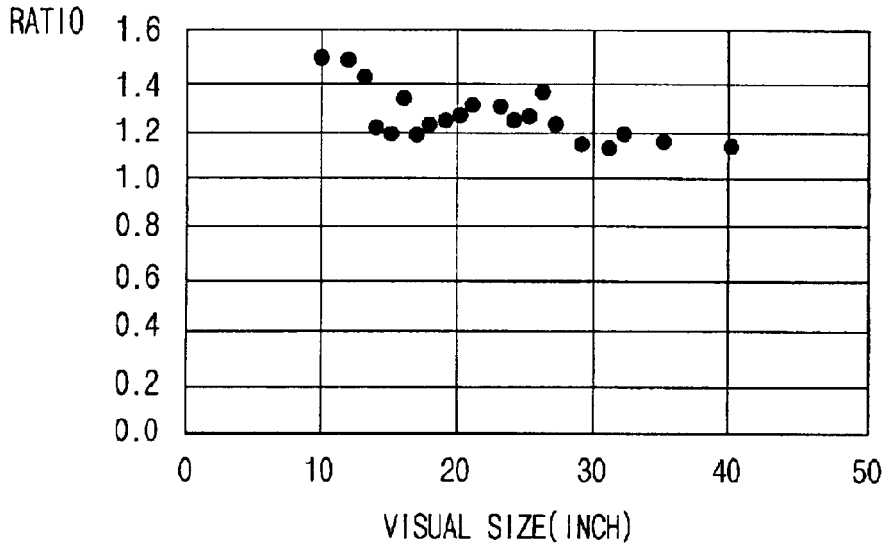
FIG. 4A CONVENTIONAL ART
FIG. 4A is a graph showing a ratio of a minimum thickness of a panel glass to a minimum thickness of a skirt portion according to a screen size.
Figure 4B:
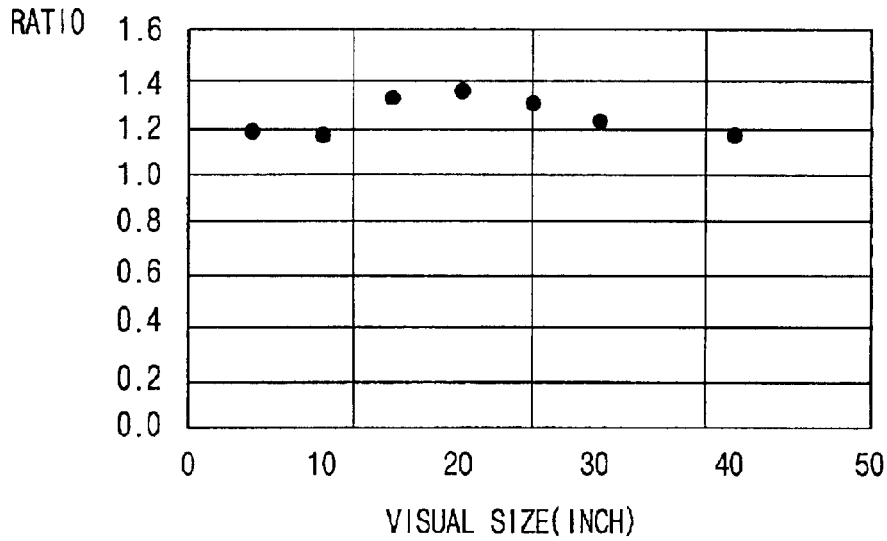
FIG. 4B CONVENTIONAL ART
FIG. 4B is a graph showing a ratio of a minimum thickness of a panel glass to a minimum thickness of a skirt portion according to a screen size.

Reference will now be made in detail to the preferred embodiments of the present invention, examples of which are illustrated in the accompanying drawings.

The same reference numerals as in the conventional art are given to those elements that are the same as those of the conventional art, of which descriptions are omitted.

The cathode ray tube of the present invention has a housing structure with a reduced full depth, in which a panel glass 1 forming a screen with a fluorescent material coated therein is positioned at the forefront, and various parts for controlling an electron beam and a cathode 8 for generating the electron beam are positioned.

A back glass 6 supporting every device is positioned at the rearmost portion, and a skirt portion 1*a* is positioned between the panel glass 1 and the back glass 6 to connect them.

The panel glass 1, the back glass 6 and the skirt portion 1*a* are all made of glass. A minimum thickness of the skirt portion 1*a* is thicker than a minimum thickness of the panel glass and a minimum thickness of the back glass.

In the cathode ray tube having the short full depth, a stress due to the atmospheric pressure applied on the outer surface of the panel glass 1 and the back glass 6 is concentrated to the skirt portion 1*a* that connects the panel glass 1 and the back glass 6.

The stress concentrating portion is varied depending on the thickness of the panel glass 1 and the back glass 6.

Figure 5A:
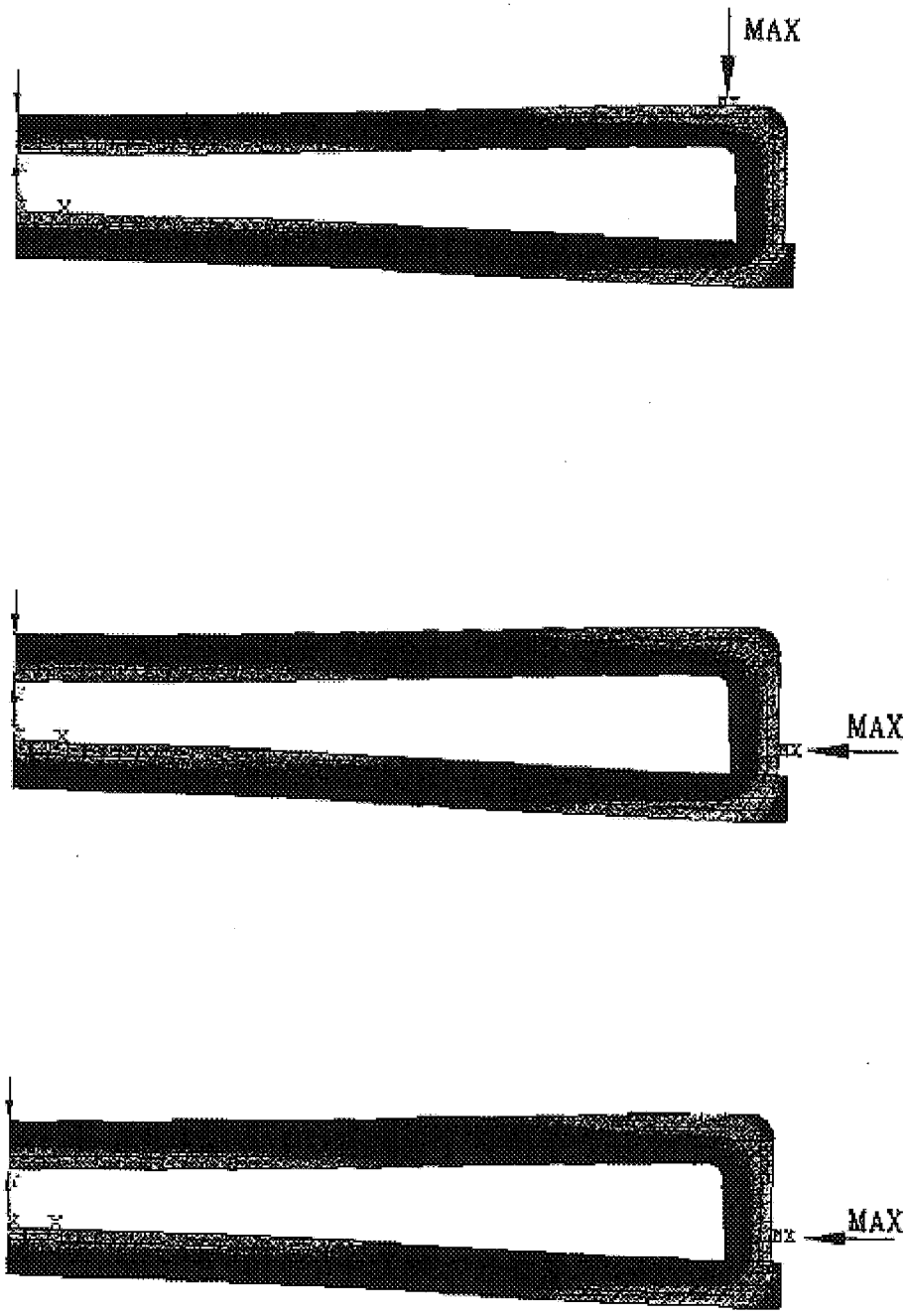
FIG. 5A shows a stress concentration distribution variation to a thickness change of the panel glass.

As shown in FIG. 5A, if the thickness of the panel glass 1 is thin, a stress is concentrated to the panel glass 1 adjacent to the skirt portion 1*a*, and thus, a great deformation occurs at the portion. In this case, if the thickness of the panel glass 1 is thick, the stress concentration is moved to the skirt portion 1*a*.

Figure 5B:
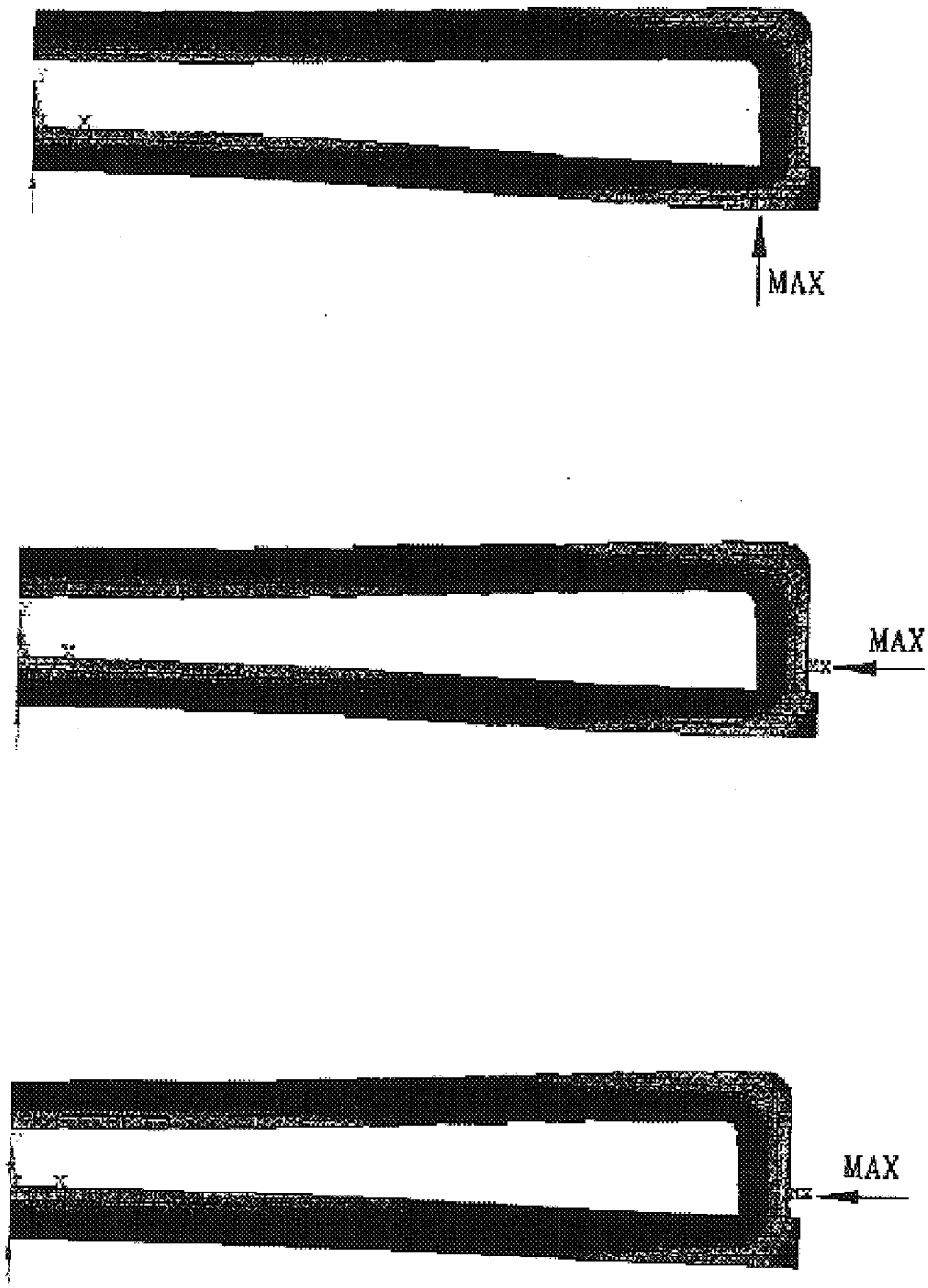
FIG. 5B shows a stress concentration distribution variation to a thickness change of the back glass.

As shown in FIG. 5B, if the thickness of the back glass is thin, a stress is concentrated to a portion where the skirt portion 1*a* and the back glass 6 meets, and thus, the portion is deformed.

At this time, if the thickness of the back glass 6 becomes thick, the stress concentration is moved to the skirt portion 1*a*.

Figure 5C:
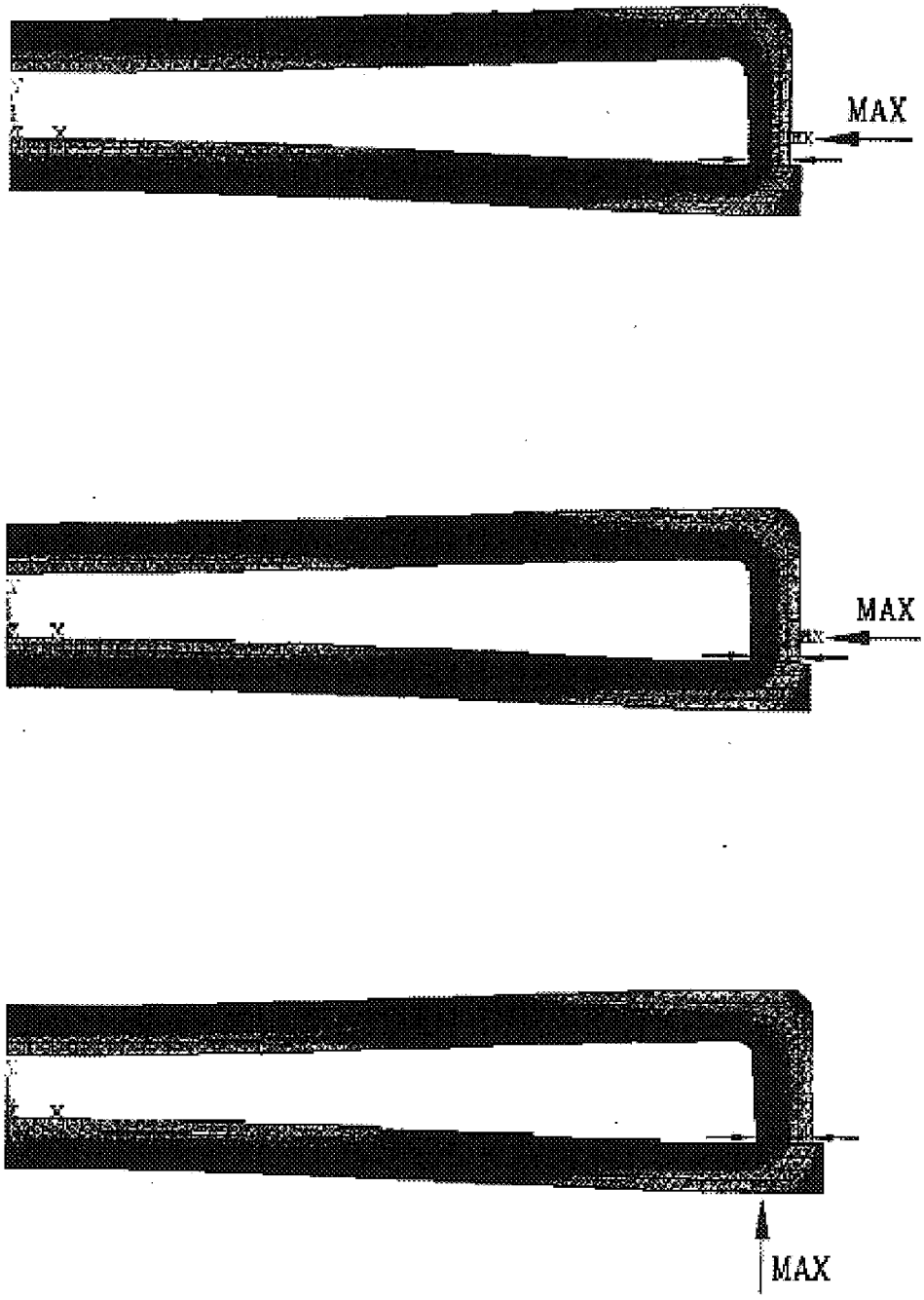
FIG. 5C shows a stress concentration distribution variation to a thickness change of a skirt portion.

Meanwhile, as shown in FIG. 5C, if the thickness of the skirt portion 1*a* is thin, a stress is concentrated to the skirt portion 1*a*. If the thickness of the skirt portion 1*a* is thick, the stress concentration is moved to the panel glass 1 or the back glass 6.

The thickness of the skirt portion 1*a* varies depending on the size of the cathode ray tube and the full depth. On the whole, if the thickness of the skirt portion 1*a* is greater than the thickness of the panel 1 glass and the thickness of the back glass 6, the stress concentration can be reduced while reducing the mass of the device.

Accordingly, the cathode ray tube of the present invention is designed to satisfy the following equation (2):

$$\frac{\text{Minium thickness of panel glass}}{\text{Minimum thickness of skirt portion}} \leq 1.0 \quad (2)$$

$$\frac{\text{Minium thickness of back glass}}{\text{Minimum thickness of skirt portion}} \leq 1.0 \quad (2)$$

For example, a design specification result of a 20 V cathode ray tube having a short full depth shows that when the thickness of the panel glass 1 is 15 mm, the thickness of the back glass 6 is 16.5 mm and the thickness of the skirt portion 1*a* is 18 mm, the cathode ray tube is designed to have a light weight and small stress deformation.

Figure 6:
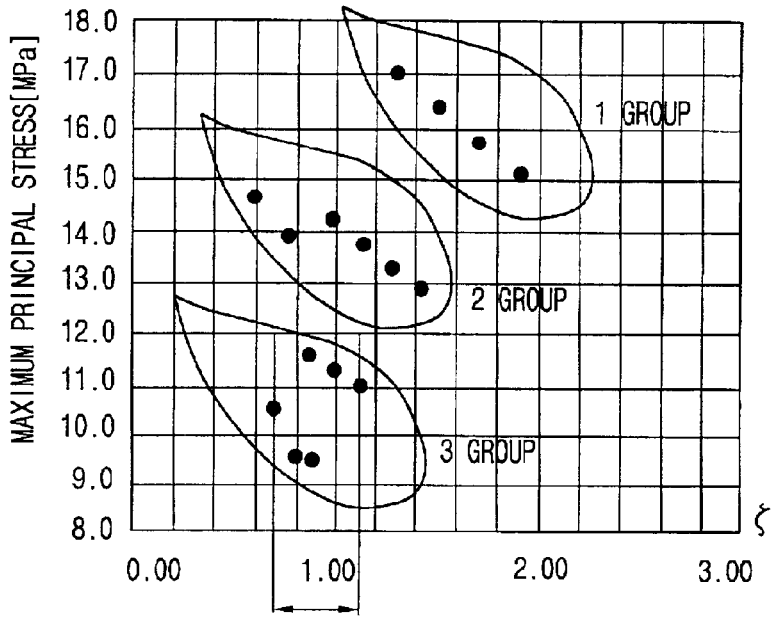
FIG. 6 is a graph showing a stress distribution for a ratio of multiplication of the minimum thickness of the panel glass and the minimum thickness of the back glass to a square of the minimum thickness of the skirt portion.

FIG. 6 is a graph showing a stress distribution for a ratio of multiplication of the minimum thickness of the panel glass and the minimum thickness of the back glass to a square of the minimum thickness of the skirt portion.

The first group has a skirt portion with a thickness of 13 mm, the second group has a skirt portion with a thickness of 15 mm, and the third group has a skirt portion with a thickness of mixture of 17 mm and 19 mm.

As noted in the graph, as the ratio of the multiplication of the minimum thickness of the panel glass 1 and the minimum thickness of the back glass 6 to the square of the minimum thickness of the skirt portion 1*a* becomes great, the volume becomes large compared to an applied stress.

Accordingly, assuming that an optimum critical stress value of a cathode ray tube is 12 Mpa, the following equation (3) can be obtained by considering the third group satisfying a practical specification of FIG. 6.

$$0.7 \leqq \zeta \leqq 1.1 \quad (3)$$

In the above formula, $\zeta$ is (minimum thickness of panel glass×minimum thickness of back glass)/minimum thickness of skirt portion$^2$.

If the thickness of the panel glass 1 is 15 mm, the thickness of the back glass 6 is 16.5 mm, and the thickness of the skirt portion 1*a* is 18 mm, a ratio of the multiplication of the minimum thickness of the panel glass 1 and the minimum thickness of the back glass 6 to the square of the minimum thickness of the skirt portion 1*a* is 0.764, which satisfies the above condition.

As noted in FIG. 6, the above formula is not always satisfied in every specification, and the formula is a relation formula satisfying the optimum design value in consideration of a mass and a stress for the thickness of the skirt portion 1*a* that satisfies a practical state to cope with the stress.

Figure 7:
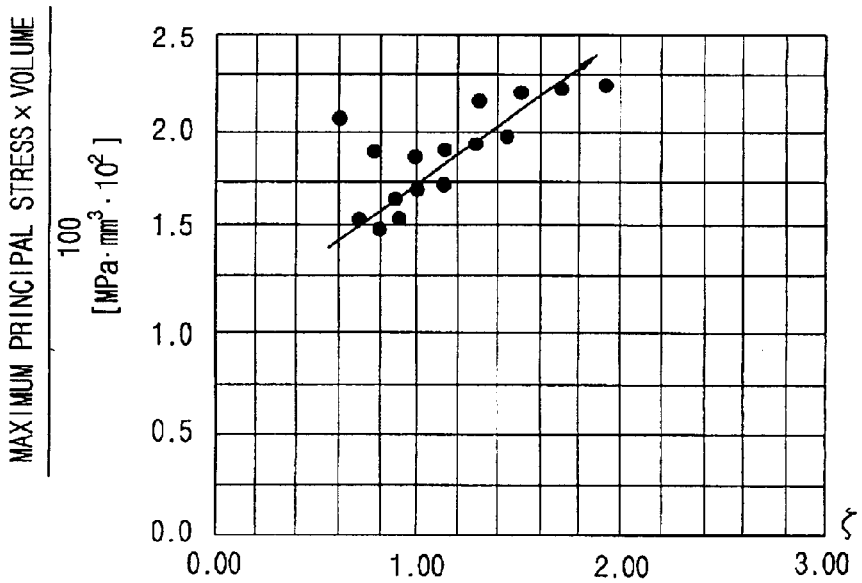
FIG. 7 is a graph showing a relation among a ratio of multiplication of the minimum thickness of the panel glass and the minimum thickness of the back glass to a square of the minimum thickness of the skirt portion, a stress and a volume.

FIG. 7 is a graph showing conditions of the stress and volume that $\zeta$ satisfies a preferable range.

In FIG. 7, a horizontal axis is $\zeta$ and a vertical axis is a value obtained by multiplying a maximum main stress applied to the glass by volume and dividing the multiplying result by 100.

As shown in FIG. 7, in order for $\zeta$ to satisfy the preferable range, that is, $0.7 \leqq \zeta \leqq 1.1$, the stress applied to the glass and the volume should be all small.

Therefore, in case of the structure that the ratio of the minimum thickness of the panel 1 glass to the minimum thickness of the skirt portion 1*a* is below 1, an effective housing structure can be provided satisfying the range of $0.7 \leqq \zeta \leqq 1.1$ while reducing the stress and the volume.

As so far described, the cathode ray tube of the present invention has the following advantages.

That is, the full length of the cathode ray tube is reduced and the weight of the cathode ray tube is minimized by controlling the thickness of the panel glass 1, the skirt portion 1*a* of the panel and the back glass 6.

In addition, the atmospheric pressure applied to the panel glass 1 and the back glass 6 is uniformly distributed to the panel glass 1, the back glass 6 and the skirt portion 1*a*, thereby performing a deformation.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A cathode ray tube, comprising:

a panel with a panel glass and a skirt portion;

a cathode mounted in the panel and generating an electron beam;

an electron beam controller for controlling and deflecting the electron beam in order to hit the fluorescent film; and a back glass attached to the panel and sealed in a state that the cathode and the electron beam controller are mounted therein, wherein a ratio of a minimum thickness of the panel glass to a minimum thickness of the skirt portion of the panel is below 1.0, and wherein the back glass is a substantially flat surface that extends approximately parallel to said panel glass.

2. The cathode ray tube of claim 1, wherein the controller comprises:

a control electrode for controlling the electron beam;

a focusing electrode for focusing the electron beam; and horizontal and vertical deflection electrodes for deflecting the electron beam.

3. The cathode ray tube of claim 1, where the cathode ray tube has a depth of below approximately 200 mm.

4. The cathode ray tube of claim 1, wherein the diagonal length of the panel is above 8 inches.

5. The cathode ray tube of claim 1, wherein the panel has a fluorescent film made of a fluorescent material coated on a surface of the panel.

6. The cathode ray tube of claim 1, wherein the minimum thickness of the skirt portion is thicker than a minimum thickness of the panel glass and a minimum thickness of the back glass.

7. The cathode ray tube of claim 1, wherein the minimum thickness of at least one of said panel glass or said skirt portion is a substantially uniform thickness.

8. A cathode ray tube, comprising:

a panel with a fluorescent film made of a fluorescent material coated at the inner surface thereof;

a cathode mounted in the panel and generating an electron beam;

an electron beam controller for controlling and deflecting the electron beam in order to hit the fluorescent film; and a back glass attached to the panel and sealed in a state that the cathode and the electron beam controller are mounted therein, wherein a ratio of a minimum thickness of the back glass to a minimum thickness of the a skirt portion of the panel is below 1.0, and wherein said back glass is a surface across from said panel that is substantially flat.

9. The cathode ray tube of claim 8, wherein the controller comprises:

a control electrode for controlling the electron beam;

a focusing electrode for focusing the electron beam; and horizontal and vertical deflection electrodes for deflecting the electron beam.

10. The cathode ray tube of claim 8, wherein the cathode ray tube has a depth of below approximately 200 mm.

11. The cathode ray tube of claim 8, wherein the diagonal length of the panel is above 8 inches.

12. The cathode ray tube of claim 8, wherein the back glass extends approximately parallel to said panel glass.

13. The cathode ray tube of claim 8, wherein the minimum thickness of at least one of said back glass or said skirt portion is a substantially uniform thickness.

14. A cathode ray tube, comprising:

a panel with a panel glass and a skirt portion;

a cathode mounted in the panel and generating an electron beam;

an electron beam controller for controlling and deflecting the electron beam in order to hit the fluorescent film; and a substantially flat back glass attached to the panel and sealed in a state that the cathode and the electron beam controller are mounted therein, wherein the thickness of the skirt portion of the panel, the thickness of the panel glass, and the thickness of the back glass satisfy the following equation:

$$\frac{\text{thickness of panel glass} \times \text{thickness of back glass}}{\text{thickness of skirt portion}^2} \leq 1.1.$$

15. The cathode ray tube of claim 14, wherein the controller comprises:

a control electrode for controlling the electron beam;

a focusing electrode for focusing the electron beam; and horizontal and vertical deflection electrodes for deflecting the electron beam.

16. The cathode ray tube of claim 14, wherein the cathode ray tube has a depth of below approximately 200 mm.

17. The cathode ray tube of claim 14, wherein the diagonal length of the panel is above 8 inches.

18. The cathode ray tube of claim 14, wherein the thickness of the skirt portion of the panel, the thickness of the panel glass, and the thickness of the back glass satisfy the following equation:

$$0.7 \leq \frac{\text{thickness of panel glass} \times \text{thickness of back glass}}{\text{thickness of skirt portion}^2} \leq 1.1.$$

19. The cathode ray tube of claim 14, wherein the panel has a fluorescent film made of a fluorescent material coated on a surface of the panel.

20. The cathode ray tube of claim 14 , wherein the back glass extends approximately parallel to said panel glass.

21. The cathode ray tube of claim 14, wherein the thickness of at least one of said panel glass, back glass or skirt portion is a substantially uniform thickness.

* * * * *